United States Patent [19]

Adachi et al.

[11] Patent Number: 5,004,674

[45] Date of Patent: Apr. 2, 1991

[54] SILVER HALIDE PHOTOSENSITIVE MATERIAL

[75] Inventors: Keiichi Adachi; Kazunobu Katoh, both of Kanagawa; Kouichi Kawamura, Shizuoka, all of Japan

[73] Assignee: Fuji Photo Film Co., Ltd., Kanagawa, Japan

[21] Appl. No.: 421,024

[22] Filed: Oct. 13, 1989

[30] Foreign Application Priority Data

Oct. 14, 1988 [JP] Japan ..... 63-258562

[51] Int. Cl.[5] ..... G03C 1/46

[52] U.S. Cl. ..... 430/333; 430/22; 430/334; 430/340; 430/343; 430/344; 430/502; 430/952; 430/963

[58] Field of Search ..... 430/952, 502, 333, 334, 430/340, 343, 344, 22, 963

[56] References Cited

U.S. PATENT DOCUMENTS

| | | | |
|---|---|---|---|
| Re. 28,956 | 9/1976 | Wainer | 430/334 |
| 3,042,515 | 7/1962 | Wainer | 430/344 |
| 3,511,658 | 5/1970 | Manko et al. | 430/22 |
| 3,765,895 | 10/1973 | Fox | 430/343 |
| 4,189,323 | 2/1980 | Buhr | 430/281 |
| 4,497,888 | 2/1985 | Nishioka et al. | 430/191 |
| 4,772,534 | 9/1988 | Kawamura et al. | 430/281 |

*Primary Examiner*—Charles L. Bowers, Jr.
*Assistant Examiner*—Lee C. Wright
*Attorney, Agent, or Firm*—Sughrue, Mion, Zinn, Macpeak & Seas

[57] ABSTRACT

A silver halide photosensitive material comprising a support having thereon a layer containing (a) an organic compound which releases a free radical on contact with light rays and (b) a compound which undergoes a change in the absorption spectrum due to the action of the released free radical.

6 Claims, No Drawings

SILVER HALIDE PHOTOSENSITIVE MATERIAL

FIELD OF THE INVENTION

The present invention relates to a silver halide photosensitive material which contains a compound that undergoes a change in the absorption spectrum due to the action of a compound which releases a free radical on contact with light, and to the free radical.

BACKGROUND OF THE INVENTION

It is known that a print-out image (developed image) can be obtained, albeit only slightly, from the exposure of a silver halide emulsion. Silver halide photosensitive materials for the printing industry use this characteristic, and are used as a means of checking that the right original is exposed in the correct position. However the print-out image obtained is very weak and hard to see, and in recent years attempts have been made to use fine grain emulsions to improve the quality of the image obtained from photoprocessing after exposure. Nonetheless, the finer the grain of the emulsion, the greater is its "transparency" to light. Thus, it becomes harder to obtain a print-out image and thus it is more difficult to check positioning.

SUMMARY OF THE INVENTION

An object of the present invention is to provide a silver halide photosensitive material with which a clear print-out image can be obtained and which does not depend on the printout properties of a silver halide emulsion.

A further object of the invention is to provide a silver halide photosensitive material which is highly sensitive to light in the photosensitive region and from which a well-identifiable print-out image can be obtained.

As the result of much investigation, it has now been discovered that the difficulties with prior materials can be resolved by means of the following two methods:

(1) a silver halide photosensitive material comprising a support having thereon a layer containing (a) an organic compound which releases a free radical on contact with light rays and (b) a compound which undergoes a change in the absorption spectrum due to the action of the released free radical; and (2) a silver halide photosensitive material as in (1) above, wherein the organic compound which releases a free radical on contact with light rays is a compound shown by the general formula (I) below:

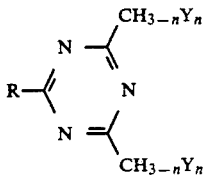

(I)

wherein Y represents Cl or Br, n is an integer from 1 to 3 and R represents an aromatic group which may or may not be substituted.

DETAILED DESCRIPTION OF THE INVENTION

The present invention is described in more detail below.

Compounds which release a free radical upon contact with light rays (hereafter "free radical formers") are well known and frequently used as photopolymerization initiators in photopolymerizable compositions. Organic halide compounds are particularly well known, and are described in, J. Kosar *Light Sensitive Systems*, pp. 180–181 and pp. 361–370, J. Kosar (J. Wiley & Sons, New York: 1965). These organic halide compounds are broken down by light to form free halide radicals such as chlorine and bromine radicals. Free halogen radicals are in turn good attractors of hydrogen, and produce acid in the presence of a hydrogen donor. Typical free radical formers are iodoform, carbon tetrabromide and tribromoacetophenone, but these all suffer the disadvantage that they sublime and produce an unpleasant odor.

If the free radical formers used in the invention do not suffer these disadvantages they can be used, but the compound shown in general formula (I) is preferable.

In formula (I), Y represents Cl or Br, and n is an integer from 1 to 3. R represents an aromatic group having from 6 to 10 carbon atoms which may or may not be substituted (for example phenyl, naphthyl). Suitable substituent groups include an alkyl group having from 1 to 20 carbon atoms (such as methyl, ethyl, carboxymethyl, chloroethyl, sulfoethyl, methoxyethyl), an alkoxy group having from 1 to 20 carbon atoms (such as methoxy, ethoxy), an aryl group having 6 to 20 carbon atoms (such as phenyl, m-sulfophenyl), a halogen atom (such as Cl, Br), a hydroxyl group, a carboxyl group, a sulfo group, an alkoxycarbonyl group having from 1 to 20 carbon atoms (such as ethoxycarbonyl, 2-sulfoethoxy-carbonyl), a carbamoyl group having from 1 to 20 carbon atoms (such as carbamoyl, 2-hydroxyethylcarbamoyl), an acylamino group having from 1 to 20 carbon atoms (such as acetylamino, o-sulfobenzoylamino, trifluoroacetylamino), an amino group having from 1 to 20 carbon atoms (such as N,N-dicarboxymethyl, N-ethyl-N-sulfoethyl, N,N-diethoxycarbonylmethyl), a sulfamoyl group having from 1 to 20 carbon atoms (such as phenylsulfamoyl, sulfamoyl), a sulfonamido having from 1 to 20 carbon atoms group (such as methanesulfonylamino, phenylsulfonylamino), and like groups are preferred.

Examples of free radical formers that can be used in the invention are shown below. However, the invention is not to be constructed as being compounds limited to these.

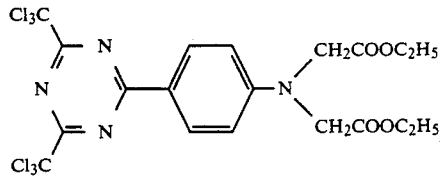

(I-1)

-continued
(I-2)
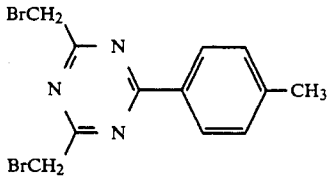
(I-3)
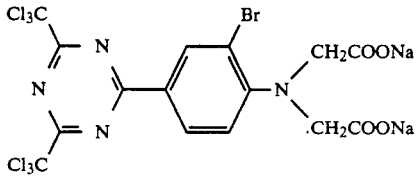
(I-4)
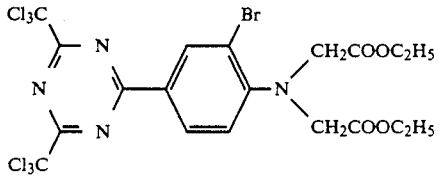
(I-5)
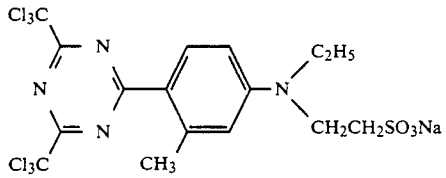
(I-6)
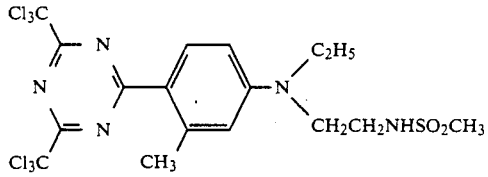
(I-7)
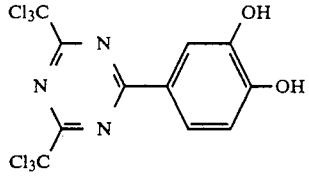
(I-8)
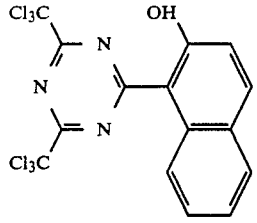
(I-9)
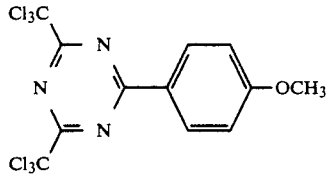

-continued
(I-10)
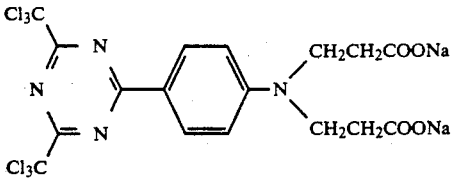
(I-11)
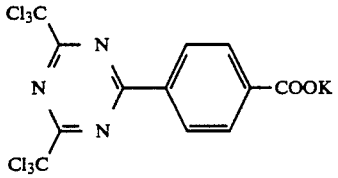
(I-12)
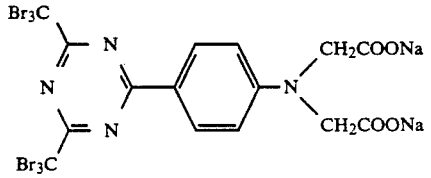
(I-13)
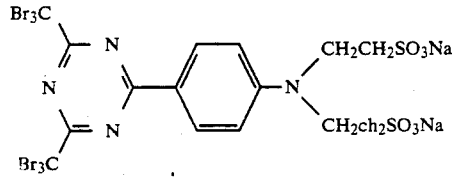
(I-14)
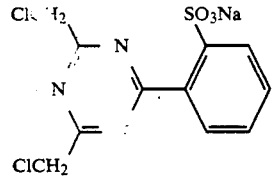
(I-15)
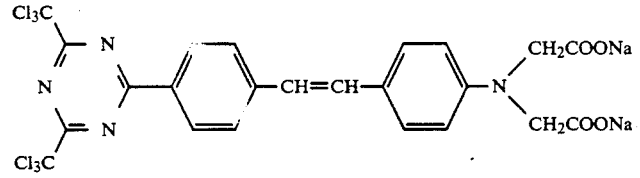
(I-16)
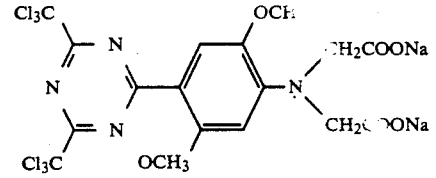
(I-17)
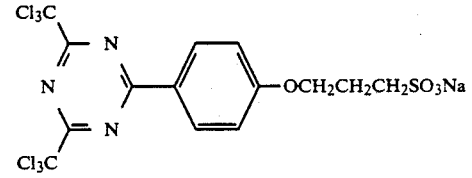
(I-18)
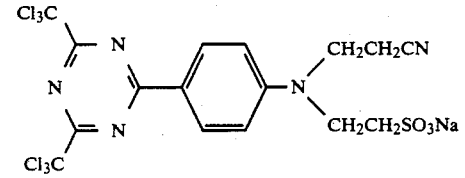

-continued (I-19)

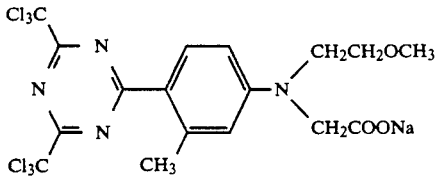

(I-20)

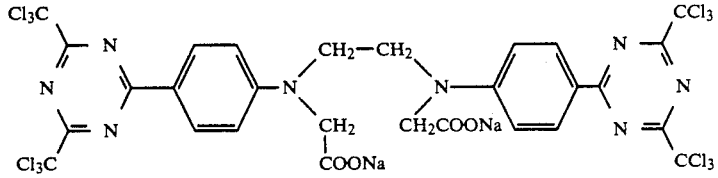

(I-21)

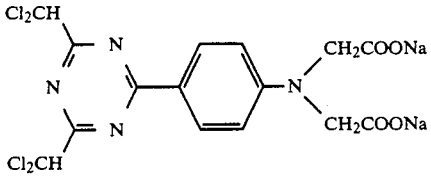

(I-22)

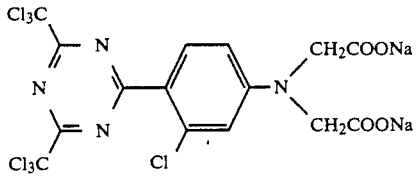

The free radical formers to be used in the invention can be synthesized using aromatic nitrile compounds and haloacetonitriles by cyclization in accordance with the method described in K. Wakabayashi, *Bulletin of the Chemical Society of Japan,* 42, 2924–2930 (1969)

The following synthesis examples are given to further illustrate the synthesis of the free radical formers which can be used in the present invention. Unless otherwise indicated, all parts, percents, ratios and the like are by weight.

SYNTHESIS EXAMPLE NO. 1

29g of N,N-diethoxycarbonylmethyl-p-cyanoaniline and 86g of trichloroacetonitrile were ice-cooled and mixed, and after adding 2.8g of aluminum bromide, HCl gas was bubbled through the mixture for 1.5 hours. The mixture was then left to react for 10 hours at room temperature, after which 16g of bromine was added dropwise and the mixture again left to react for 3 hours. 400 ml of ethanol was then added, and crystals precipitated out at room temperature. The crystals were filtered out and dried, yielding 52g of Compound (4). Melting point 119–123° C.

SYNTHESIS EXAMPLE NO. 2

20g of Compound (4) was added to a mixed solution of 100 ml of concentrated hydrochloric acid and 200 ml of acetonitrile and refluxed for 3 hours. After cooling, it was extracted with ethyl acetate and, after washing with water, the ethyl acetate layer was concentrated. The residue was dissolved in a mixture of 250 ml ethanol and 50 ml water, and neutralized with sodium hydroxide solution. After removing the precipitate, the mixture was evaporated and dried out, yielding 13g of Compound (3). Melting point 194° C (decomposes).

There are two types of compound (hereafter color alterant) which undergo a change in the absorption spectrum due to the free radical which can be used in this invention as a result of the action of the photodecomposition products of the free radical formers: those which change from an originally colorless state to a colored state, and those types which orginally have an intrinsic color and undergo a change in color or lose color.

Arylamines are typical of color alterants which belong to the former group. In addition to simple arylamines such as primary and secondary aromatic amines, the so-called leuco dyes are also included as arylamines which are suited to this purpose.

Diphenylamine, triphenylamine, dibenzylaniline, p-toluidine, o-chloroaniline, N-methyldiphenylamine, p,p'-tetramethyldiaminodiphenylmethylamine, p,p'p''-triaminotriphenylcarbinol, p,p'p''-triaminophenylmethane, p,p'p''-hexamethyltriaminotriphenylmethane are examples of these compounds.

At the same time, all of the following types of dyes can be effectively used as color alterants which have an original intrinsic color but change color or lose color due to the photodecomposition products of the free radical formers: diphenylmethane-, triphenylmethane-, thiazine-, oxazine-, xanthene-, anthraquinone-, iminonaphthoquinone-, azo-, azomethylene-, cyanine-, merocyanine-, oxonol- and benzylidene- based dyes and the like. Suitable examples of these include eosin, crystal violet, phenolphthalein, rose bengal, methyl orange, malachite green, methylene blue, Orient oil blue #603 (a product of Orient Kagaku Kogyo Ltd.), oil yellow GGS (a product of Orient Kagaku Kogyo Ltd,), eisen astra floxene FF conc. (a product of Hodogaya Kagaku Kogyo Ltd.), eisen cation pink FGH (a product of Hodogaya Kagaku Kogyo Ltd.), Rhodamine B, Rhodamine 6G, 4-p-diethylaminophenyliminonaphthquinone, 1-phenyl-3-methyl-4-p-diethylaminophenylimino-5-pyrazolone, Victoria pure blue (CI42595),

F-1

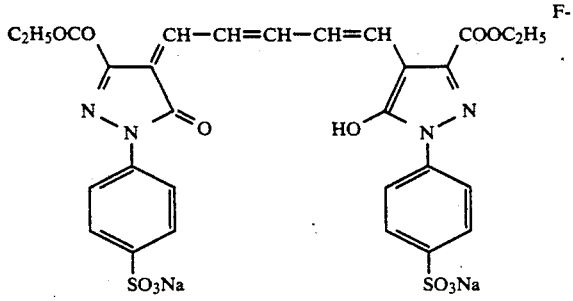

F-2

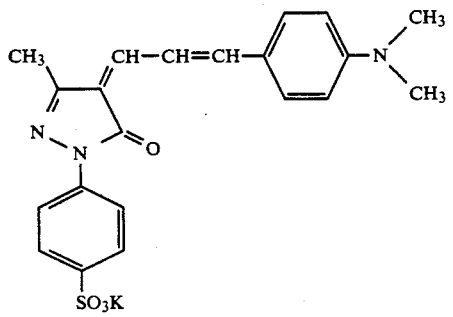

F-3

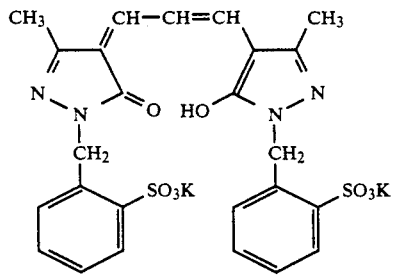

F-4

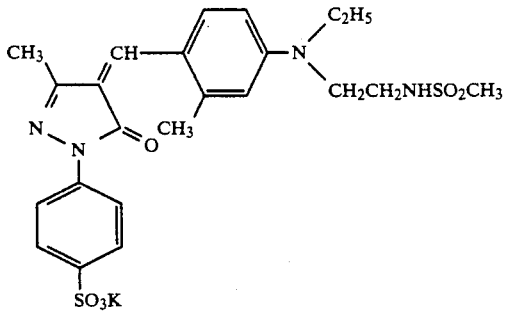

F-5

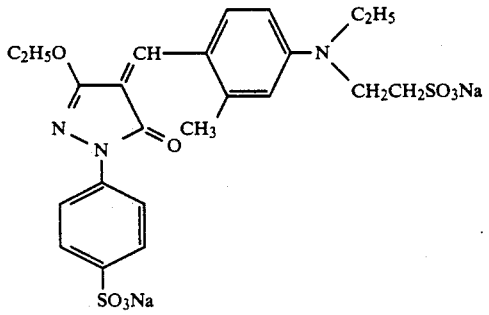

-continued

F-6

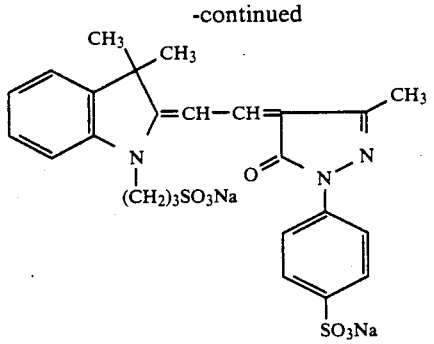

It is preferable that the color alterants used in this invention elute or lose their color in the developing process.

The ratio of the color alterants to the free radical formers should be within the range of 1 part by weight of color alterant to about 0.01–about 100 parts of free radical formers, or more preferably 0.1 to 10 parts, or most preferably 0.5–5 parts by weight. The color alterants may be mixed with any of the free radical formers. Use of the color alterants should preferably be in the range of 1.0–1000 mg/m$^2$ of the silver halide photo-sensitive material, or more preferably 10–200 mg/m$^2$.

The layer containing the color alterants and the free radical formers can be provided in a variety of positions in the invention. For example, it can be provided in a back layer, or in a layer between the support and the photo-sensitive silver halide emulsion layer or above the silver halide emulsion layer.

The layer containing the color alterants and free radical formers in this invention may be formed using, as a binder, a water-insoluble polymer such as a formaldehyde resin, acrylic resin, copolymerized acrylic resin, vinyl chloride resin, vinyl acetate resin or a partially saponified vinyl acetate resin, styrol resin, acetal resin, fiber element resin and the like. These polymers and the above components can be formed into a layer by dissolving in an organic solvent such as ethyl acetate, methylene chloride, acetone, alcohol, benzene, toluene, methyl ethyl ketone, tetrahydrofuran and the like, and applied using a conventional coating method.

Alternatively, water-soluble polymers such as gelatin, casein, polyvinyl alcohol, polyacrylamide, water-soluble acrylic acid copolymerized resin, water-soluble cellulose derivatives and the like may also be used as binders.

In this case, the color alterants and free radical formers may be dissolved in one of the organic solvents, and are stirred into an aqueous solution of these water-soluble polymers using a high-speed stirrer and used as fine dispersion, or added in a powder form and dispersed as a fine dispersion using a dispersing medium such as a ball mill, a colloid mill or a sand mill. Moreover, if the water-insoluble polymers are dissolved in the organic solvent together with the color alterants and free radical formers, it is preferable to obtain a stable dispersion by dissolving the color alterant and the free radical former in a hydrophobic polymer in a water-soluble binder to form a colloid disperion.

The ratio of the water-insoluble binder should be between 0.1–1000 times by weight, and preferably between 1–100 times by weight the weight of the color alterant. When the compounds are dissolved in a water-soluble binder, a relatively smaller proportion can be used. The weight of water-soluble binder used is between 0.5–1000 times, and preferably between 1–100 times the weight of the color alterant.

The ratio of the free radical former to binder is determined from the above ratio of color alterants to free radical formers.

The silver halide emulsion used in the invention may be composed of silver chloride, silver chlorobromide, silver iodobromide, silver iodochlorobromide or the like, but it is preferable to use a silver halide comprising at least 60 mol % or more, and particularly 75 mol % or more of silver chloride. Silver chlorobromide or silver chloroiodobromide containing 0–5 mol % silver bromide is preferable.

The preferred average particle size of the silver halides used in the invention is "fine" (for example 0.7μ or less), with 0.5μ or less being particularly preferred. There is no particular limit in principle to the distribution of the particle size, but a monodisperse emulsion is preferable. The term 'monodisperse' in this context means that at least 95% of the particles either by weight or by number of particles are within ±40% of the average particle size.

The grains of the silver halide used in the photographic emulsion may either be regular cubic or octahedral crystals or irregular spherical or tabular crystals, or a combination of these crystal forms.

The interior and surface layers of the silver halide grains may be of a uniform phase, or different phases. It is acceptable to use a mixture of two or more silver halide emulsions formed separately.

Rhodium salts or complex salts therof can be present in the silver halide emulsion used in the invention.

Rhodium salts include rhodium monochloride, rhodium dichloride, rhodium trichloride and ammonium hexachlororhodate, but it is preferable to use a water-soluble trivalent rhodium halogen complex such as a hexachlororhodic (III) acid or one of its salts (the ammonium salt, sodium salt, potassium salt, etc.).

The amount of these water-soluble rhodium salts is within the range $1.0\times10^{-5}$ to $1.0\times10^{-3}$ moles, preferably $5.0\times10^{-5}$ to $5.0\times10^{-7}$ moles per mole of silver halide.

If the amount of rhodium salt exceeds $10^{-3}$ moles, it is impossible to achieve sufficient contrast. Conversely, if the amount is below $10^{-5}$ moles, it is impossible to achieve lowered speeds required for a bright room material.

The preferred time for adding the rhodium salt is during the process of formation or physical ripening of the silver halide grains during preparation of the silver halide emulsion.

In addition to rhodium salts, it is also possible to include cadmium slats, sulfurous acid salts, lead salts, thallium salts and iridium salts.

The silver halide photosensitive material in this invention may also include an organic desensitizer. This organic desensitizer should preferably include one or more water-soluble groups or groups dissociating in alkali.

The organic desensitizer used in this invention is determined by its polarographic half-wave potential, in other words, the redox potential determined through polarography, and the sum of its polaro-positive terminal potential and negative terminal potential is positive. The measurement of the redox potential on a polarograph is described, for example, in U.S. Pat. No. 3,501,307. The water-soluble group at least one of which is present, will in practical terms be a sulfonic acid group, a carboxylic acid group, a phosphonic acid group or the like and these groups may form a salt with an organic base (such as ammonia, pyridine, triethylamine, piperidine, morpholine and the like) or an alkali metal (such as sodium, potassium or the like).

The group dissociating in alkali gives rise to a proton-loss reaction at the pH of the developing solution (usually within the range of pH 9–pH 13, although developing solutions with a different pH are possible) or at a pH below this, and an anionic substituent group. Specifically, it has a hydroxyl group and a substituent group in which there is present at least 1 hydrogen atom bonded to the nitrogen atom, which is a substituent group such as a substituted or unsubstituted sulfamoyl group, a substituted or unsubstituted carbamoyl group, a sulfonamido group, acylamino group or substituted or unsubstituted ureido group.

Furthermore, heterocyclic groups with a hydrogen atom on the nitrogen atoms composing the hetero ring of the nitrogen-containing hetero ring are also included as the groups dissociating in alkali.

These water-soluble groups and groups dissociating in alkali may be attached to any part of the organic desensitizer. Two or more of them may be present at the same time.

Preferred examples of organic desensitizers which can be used in this invention are described in JP-A-63-64039 (The term "JP-A" as used herein means an "unexamined published Japanese patent application"), and some examples of these are listed below:

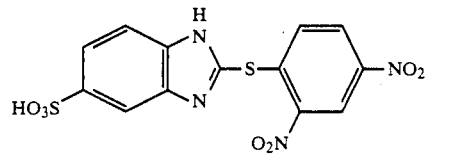

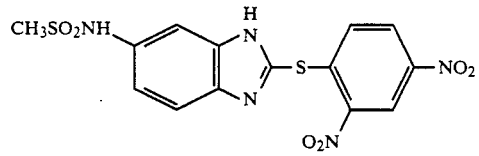

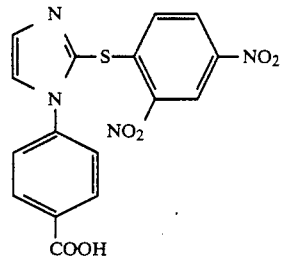

The organic desensitizer should be present in the silver halide emulsion layer at $1.0\times10^{-8}$–$1.0\times10^{-4}$ mol/m$^2$, more particularly $1.0\times10^{-7}$–$1.0\times10^{-5}$ mol/m$^2$.

Th emulsion layer and other hydrophilic colloid layers in this invention may include water-soluble dyes as filter dyes, to prevent irradiation, or for a variety of other purposes. The filter dyes used are selected to further reduce the photographic speed and are preferably ultraviolet absorbers with a maximum spectral absorption in the intrinsic sensitivity range of the silver halides, and dyes which absorb light substantially mainly in the 350 nm–600 nm range in order to prevent a fogging from taking place by a safe light when handling it as a bright room photosensitive material.

Depending on their purpose, these dyes are preferably either added to the emulsion layer or added and fixed with a mordant in the non-photosensitive hydrophilic colloid layer above the silver halide emulsion layer, i.e. further away from the support than the emulsion layer.

Specific examples of such dyes are described in detail in JP-A-63-64039, and a few examples are listed below:

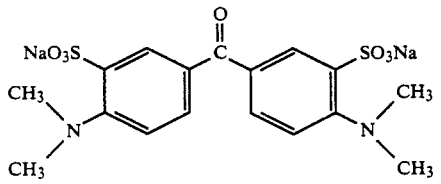

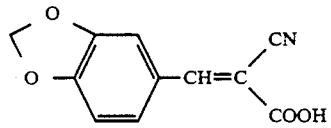

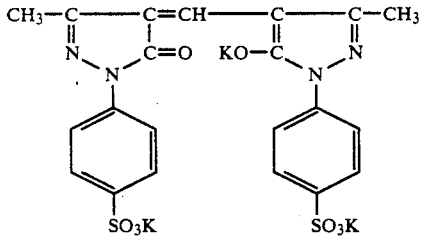

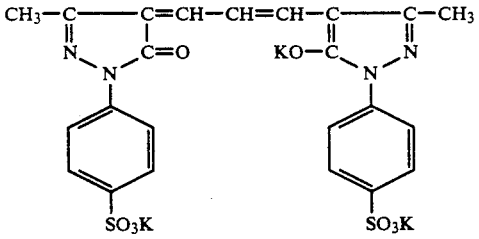

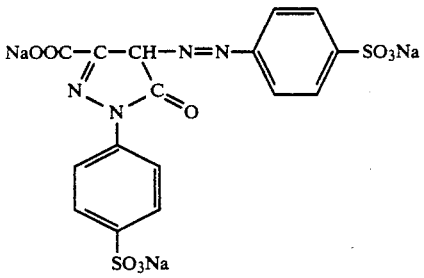

-continued

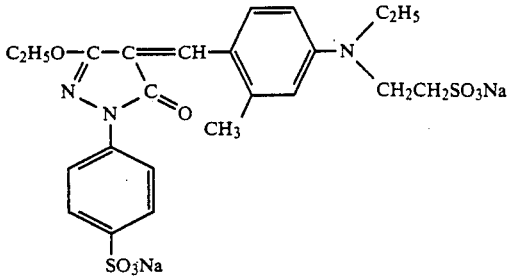

The dyes are dissolved in a suitable solvent (for example water, an alcohol (such as methanol, ethanol, propanol) acetone, methyl cellosolve and the like or mixed solvents of these) and added to the solution to be used for coating on the non-photosensitive hydrophilic colloid layer of this invention.

Two or more of these dyes may be combined and used together.

The dyes used in this invention are employed in sufficient quantity to enable the material to be used in a bright room. Actual quantities of the dye are generally from $10^{-3}$ g/m$^2$ to 1 g/m$^2$, and in particular it will be found preferable to keep the quantity within the range of $10^{-3}$ g/m$^2$ to 0.5 g/m$^2$.

Although it is convenient to use gelatin as the binder and as a protective colloid for the photographic emulsion, it is possible to use other hydrophilic colloids. For example, it is possible to use a variety of synthetic hydrophilic macromolecular materials, for example, proteins such as gelatin derivatives, graft polymers of gelatin and other macromolecules, albumin, casein; cellulose derivatives such as hydroxyethyl cellulose, carboxymethyl cellulose, cellulose sulphate esters and the like, sodium alginate, starch derivatives and other sugar derivatives, polyvinyl alcohol, partly acetalized polyvinyl alcohol, poly-N-vinylpyrrolidone, polyacrylic acid, polymethacrylic acid, polyacrylamide, polyvinylimidazole, polyvinylpyrazole and other homo- and co-polymers.

The gelatin used may be lime-treated or acid-treated and it is also possible to use gelatin hydrolysis products, gelatin enzymolysis products and the like.

The silver halide emulsion used in the method of the invention does not have to be chemically sensitized, although it may be so sensitized. Known methods of chemically sensitizing silver halide emulsions are sulfur sensitizing, reduction sensitizing and noble metal sensitizing and any of these methods may be carried out, either alone or in combination.

Among the methods of noble metal sensitization, gold sensitization is the most representative, and a gold compound, usually a complex gold salt, is used. The complex salts of other noble metals such as platinum, palladium, iridium and so on may also be present. Specific examples are described in U.S. Pat. No. 2,448,060 and U.K. Patent 618,061.

Various sulfur compounds other than the sulfur compounds included in gelatin such as thiosulfates, thiourea, thiazoles, thiocyanates and so on may be used as a sulfur sensitizer.

Stannous salts, amines, formamidine-sulfinic acid, silane compounds and the like can be used as as reduction sensitizers.

The silver halide emulsion layer used in the invention may contain known spectral sensitizing dyes.

The photosensitive material in this invention may contain a number of compounds to prevent fogging during the manufacturing process, during storage and developing or to stabilize the photographic performance. In other words, a large number of compounds known to prevent fogging or stabilize photographic properties may be added, such as azoles, for example benzothiazolium salts, nitroindazoles, cholorobenzimidazoles, bromobenzimidazoles, mercaptothiazoles, mercaptobenzothiazoles, mercaptothiadiazoles, aminotriazoles, benzothiazoles, nitribenzotriazoles and so on; mercaptopyrimidines, mercaptotriazine salts; thioketo compounds such as oxazolinethione; azaindenes, for example triazaindenes, tetraazaindenes (in particular 4-hydroxy subsituted (1,3,3*a*,7) tetraazaindenes), pentaazaindenes and the like; benzenthiosulfonic acid, benzensulphinic acid, benzensulfonic acid amide and the like. Benzotriazoles (for example 5-methylbenzotriazole) and nitroindazoles (for example 5-nitroindazole) are preferred. These compounds may also be present in the processing solution.

The photosensitive material of this invention may contain inorganic or organic film hardening agents in the photographic emulsion and the hydrophilic colloid layers. For example, it is possible to use, either alone or in combination, chrome salts (e.g., chrome alum), aldehydes (e.g., glutaraldehyde), N-methylol compounds (e.g., dimethylol urea), dioxane derivatives, active vinyl compounds (e.g., 1,3,5-triacryloylhexahydro-s-triazine, 1,3-vinylsul-fonyl-2-propanol), active halogen compounds (e.g., 2,4-di-chloro-6-hydroxy-s-triazine), mucohalic acids and the like.

The photographic emulsion layer and hydrophilic colloid layers of the photosensitive material using this invention may also contain a variety of surfactants for a variety of purposes, such as coating aids, and for preventing static electricity, to improve slip, emulsion dispersal, to prevent adhesion and to improve the photographic characteristics (such as development acceleration, harder contrast and sensitization).

Non-ionic surfactants such as saponin (steroid-type), alkylene oxide derivatives (such as polyethylene glycol, polyethylene glycol/polypropylene glycol condensation products, polyethylene glycol alkyl ethers, polyethylene glycol alkyl aryl ethers, polyethylene glycol esters, polyethylene glycol sorbitan esters, polyalkylene glycol alkylamines or amides, and polyethylene oxide adducts of silicon), glycidol derivatives (such as alkenylsuccinic acid polyglyceride, alkyl phenol polyglyceride), fatty acid esters of polyhydric alcohol esters, alkyl esters of sugars and the like; anionic surfactants which contain acidic groups such as carboxyl groups, sulfo groups, phospho groups, sulfuric acid ester groups, phosphoric and acid ester groups such as alkyl carboxylates, alkyl sulfonates, alkylbenzenesulfonates, alkylnaphthalenesulfonates, alkyl sulfate esters, alkyl phosphoric acid esters, N-acyl-N-alkyltaurines, sulfosuccinic acid esters, sulfoalkylpolyoxyethylene alkylphenyl ethers, polyoxyethylene alkyl phosphoric acid esters and like, amphoteric surfactants such as amino acids, amino alkyl sulphonic acids, amino alkyl sulfuric acid and phosphoric acid esters, alkylbetaines, aminonoxides; and cationic surfactants such as alkylamino salts, aromatic or aliphatic quaternary ammonion salts, pyridinium, imidazolium and other heterocyclic quaternary ammonium salts, and phosphonium and sulphonium salts containing aliphatic or heterocyclic rings may all be used.

Preferred surfactants to be used in this invention are polyalkylene oxides with a molecular weight not less than 600 as described in JP-B-58-9412 (The term "JP-B" as used herein means an "examined Japanese patent publication"). It is possible to use polymer latexes such as polyalkyl acrylates for dimensional stability.

It is preferable to use hydrazine derivatives as a high contrasting agent in this invention. The preferred hydrazine derivative is represented by the general formula (II) below:

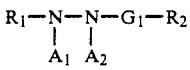

(II)

wherein $R_1$ represents an aliphatic group or an aromatic group; $R_2$ represents a hydrogen atom, an alkyl group, an aryl group, an alkoxy group, an aryloxy group, an amino group, a hydrazino group, a carbamoyl group or an oxycarbonyl group; $G_1$ represents a carbonyl group, a sulfonyl group, a sulfoxy

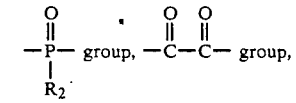

a thiocarbonyl group or an iminomethylene group; $A_1$ and $A_2$ each represents a hydrogen atom or when one of $A_1$ or $A_2$ represents a hydrogen atom, another represents a substituted or unsubstituted alkylsulfonyl group, a substituted or unsubstituted arylsulfonyl group, or a substituted or unsubstituted acyl group.

Specific examples of preferred compounds are given below. However, the invention is not to be constructed as being limited to the compounds listed below:

(II-1)

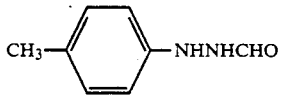

(II-2)

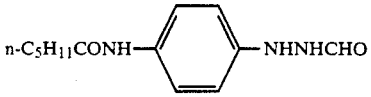

(II-3)

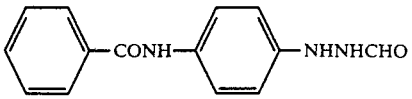

-continued
(II-4)
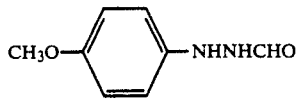
(II-5)
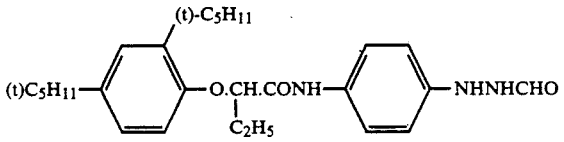
(II-6)
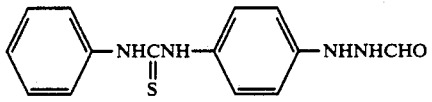
(II-7)
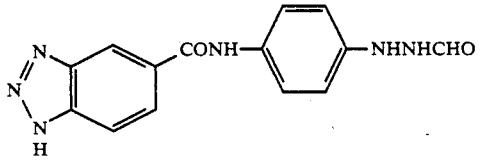
(II-8)
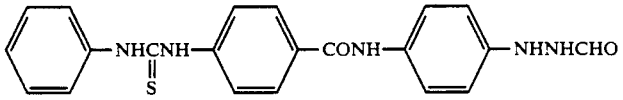
(II-9)
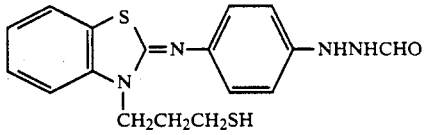
(II-10)
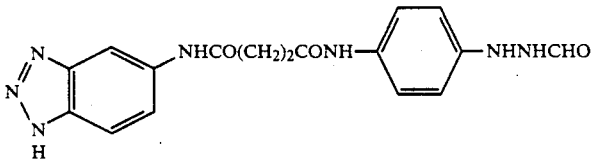
(II-11)
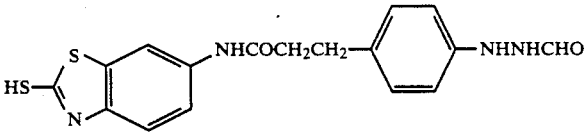
(II-12)
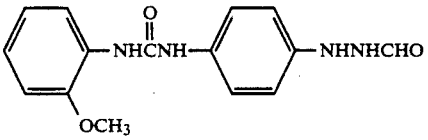
(II-13)
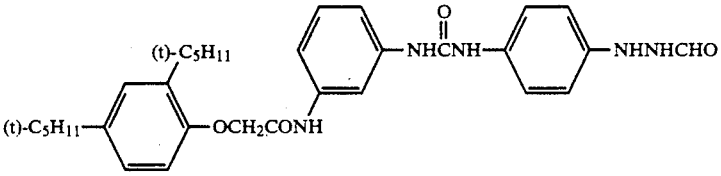
(II-14)
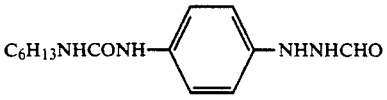

-continued
(II-15)
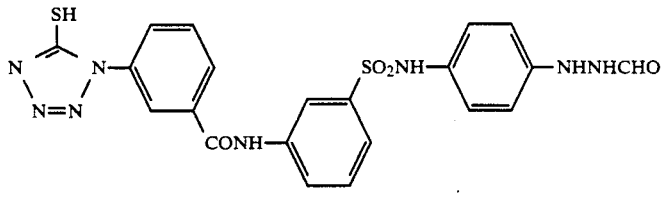
(II-16)
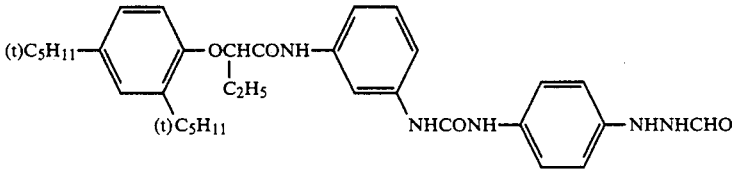
(II-17)
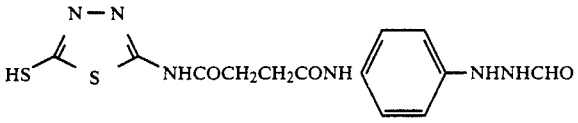
(II-18)
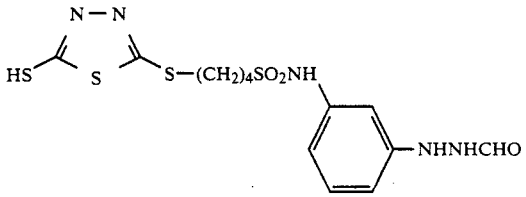
(II-19)
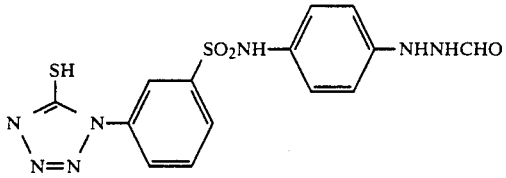
(II-20)
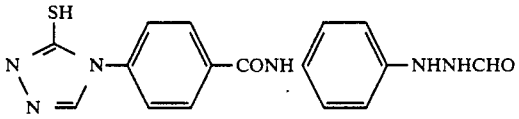
(II-21)
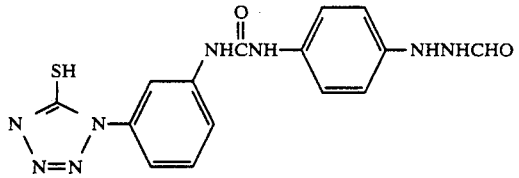
(II-22)
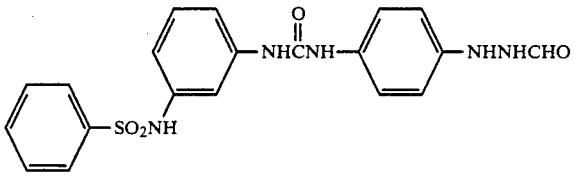
(II-23)
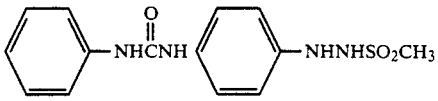

-continued
(II-24)
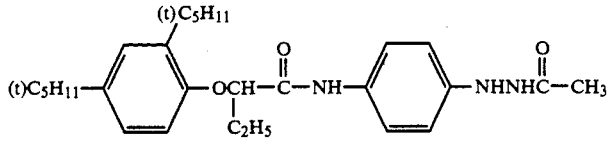
(II-25)
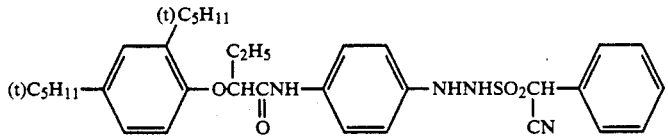
(II-26)
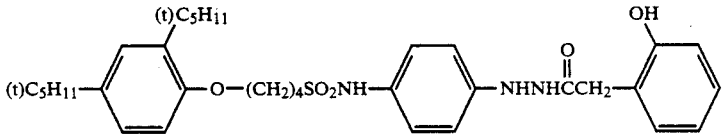
(II-27)
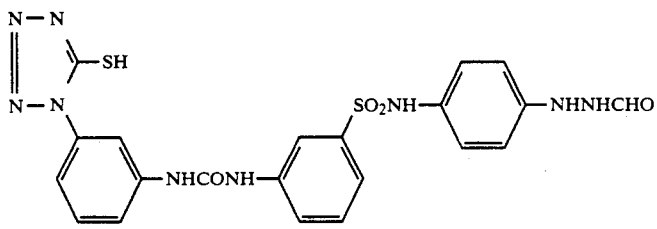
(II-28)
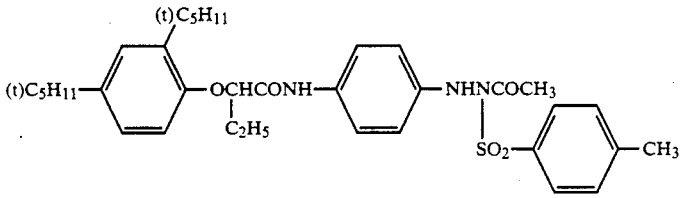
(II-29)
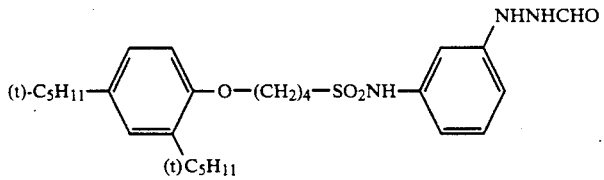
(II-30)
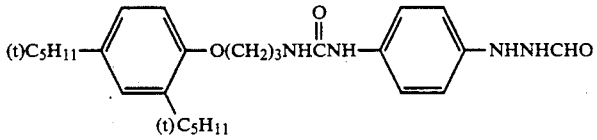
(II-31)
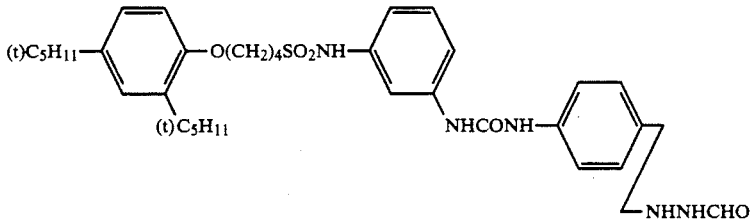
(II-32)
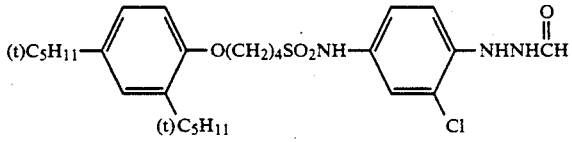

-continued
(II-33)
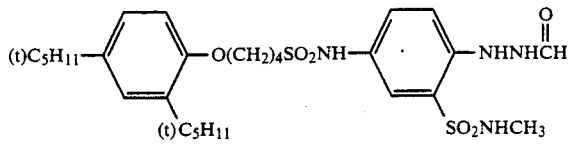
(II-34)
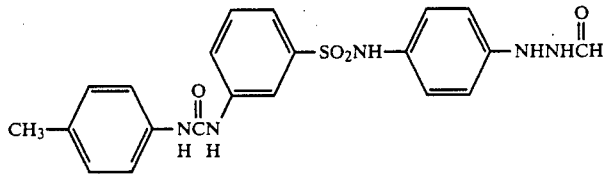
(II-35)
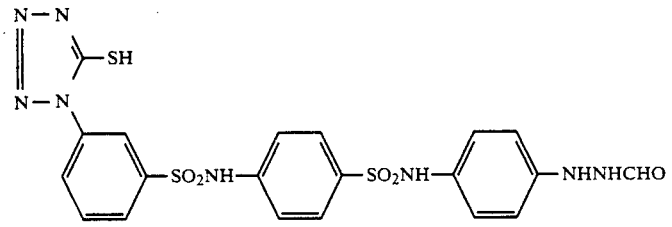
(II-36)
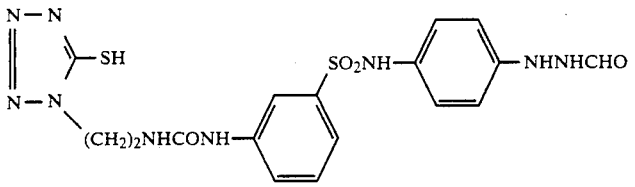
(II-37)
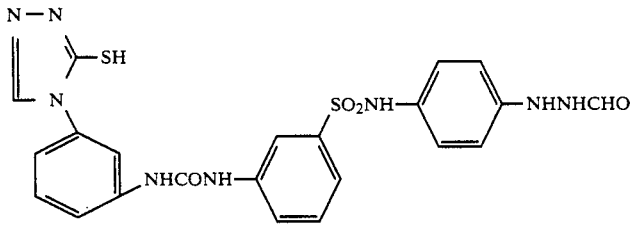
(II-38)
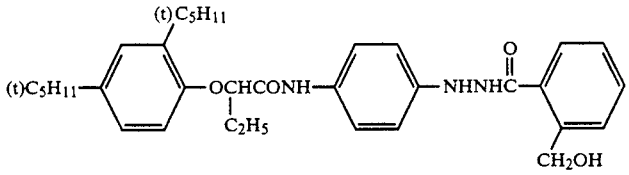
(II-39)
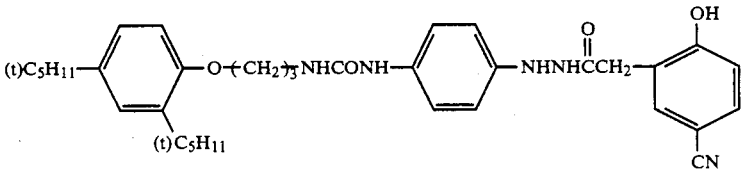
(II-40)
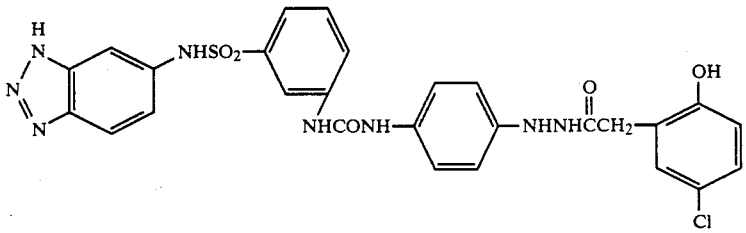

-continued (II-41)

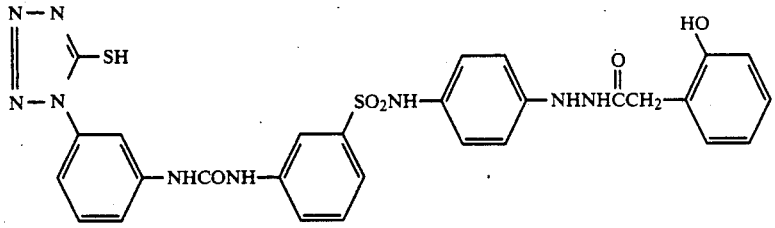

(II-42)

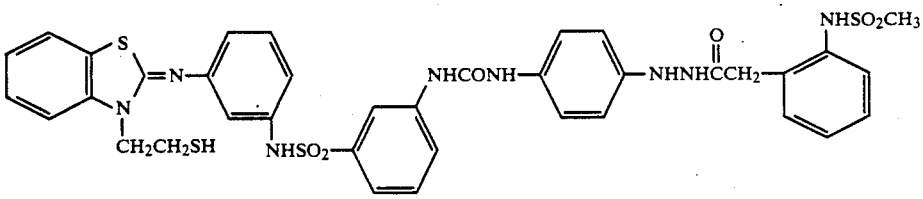

(II-43)

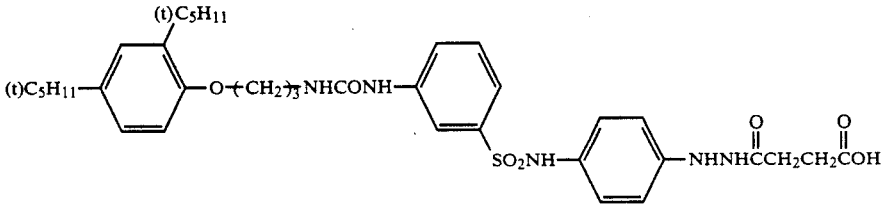

(II-44)

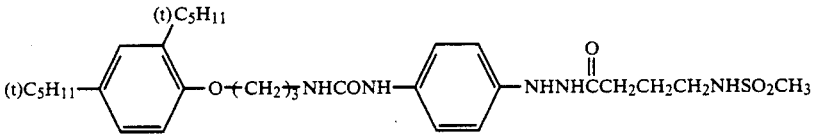

(II-45)

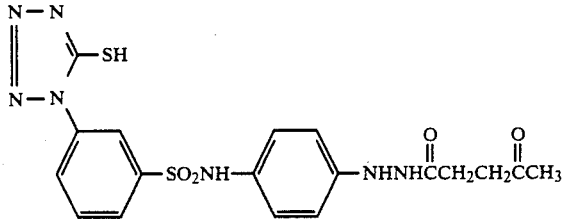

Apart from the hydrazine derivatives listed above for use in the invention, it is possible to use those described in *Research Disclosure,* Item No. 23516 (November 1983 issue, p.346) and in the literature cited therein, as well as U.S. Pat. No. 4,080,207, 4,269,929, 4,276,364, 4,278,748, 4,385,108, 4,459,347, 4,560,638, 4,478,928 and 4,686,167; U.K. Patent 2,011,391B, JP-A-60-179734, JP-A-61-170733, JP-A61-270744, JP-A-62-948, JP-A-62-178246, JP-A-62-270948, JP-A63-29751, JP-A-63-32538, JP-A-63-104074, JP-A-63-121838, JP- L-A-63-129337, JP-A-63-223744, JP-A-63-234244, JP-A-63-234245, JP-A-63-234246, JP-A-63-294552, JP-A-63-306448, and JP-A-110233 and European Patent 217,310.

The hydrazine derivatives used in the invention should preferably be used in a ratio of $10^{-6}$ mol-$1\times10^{-1}$ mol per 1 mol of silver halide, and particularly within the range $10^{-5}$-$4\times10^{-2}$ mol. However, the content of the compounds should be carefully selected depending on the particle size of the silver halide emulsion, the composition of the halide, the degree of and method used for chemical sensitization, the relationship between the layer that contains them and the photographic emulsion layer, the type of compounds used to prevent fogging, and so on.

In a silver halide photosensitive material according to the present invention, a photographic emulsion layer and other layers are coated or a flexible support made of a plastic film, paper and cloth or a rigid support made of a glass, earthware and metal which are conventionally used in a photographic material. Suitable flexible supports include a semi-synthetic or synthetic film made of cellulose nitrate, cellulose acetate, cellulose butyrate, polystyrene, poly(vinyl chloride), polyethylene tetrephthalate, and polycarbonate and a paper coated or laminated thereon a baryta layer or α-olefin polymer (e.g., polyethylene, polypropylene, ethylene/butene copolymer). A support may be colored by a dye or a pigment. A support may be blackened for the purpose of shielding. Usually the surface of a support is undercoated to improve adhesion to a photographic emulsion layer and the like. The surface of a support may be subjected to a glow discharge, a corona discharge, an ultraviolet light irradiation, or a flame treatment.

To obtain super-contrast photographic characteristics with the silver halide photosensitive emulsion in this invention, it is not necessary to use conventional infectious developers or the high-alkali developing solution with a pH close to 13 as described in U.S. Pat. No. 2,419,975. A stable developing solution can be used.

In other words, a sufficiently super-contrast negative image can be obtained with the silver halide photosensitive emulsion of this invention using a pH 10.5–12.3 and particularly a pH 11.0–12.0 developing solution containing 0.15 mol/l or more of sulfite ions as a preservative.

The main developing agents used in the method of the invention are not limited, and may include, either alone or in combination, dihydroxybenzenes (such as hydroquinone), 3-pyrazolidones (such as 1-phenyl-3-pyrazolidone, 4,4-dimethyl1-phyenyl-3-pyrazolidone), aminophenols (such as N-methyl-p-aminophenol).

The silver halide photosensitive material of this invention is particularly suitable for processing in a developing solution of which the main developing agents are dihydroxybenzenes, and auxiliary developing agents are 3-pyrazolidones or aminophenols. Preferably, the developing solution contains a range of 0.05–0.5 mol/l for the dihydroxybenzenes and 0.06 mol/l or less for the 3-pyrazolidones or aminophenols in combination.

It is possible to accelerate the developing process and shorten the developing time by adding amines to the developing solution as described in U.S. Pat. No. 4,269,929.

In addition to this, the developing solution may also contain alkali metal sulfites, carbonates, borates, phosphates and like pH buffers, and developing inhibitors and antifoggants such as bromides, iodides, and organic antifoggants (nitroindazoles and benzotriazoles are especially preferred). Where necessary water softeners, auxiliary solvents, toners, development accelerators, surfactants (particulary preferred are the polyalkylene oxides already mentioned), anti-foam agents, hardening agents, and anti-silver-staining agents (for example, 2-mercaptobenzimidazole sulfonic acid).

Photographic processing is preferably done using an automatic developer and according to the method of this invention, photographic characteristics of a sufficiently super-contrast negative gradation can be obtained from the photosensitive material even if the total processing time from start to finish in the automatic development machine is set at between 90–120 seconds.

As an anti-silver-staining agent, the compound described in JP-A-56-24347 can be used in the developing solution of this invention. As an auxiliary solvent added to the developing solution, the compound described in JP-A-61-267759 can be used. As a pH buffer used in the developing solution, either the compound described in JP-A-60-93433, or that in JP-A-61-28708 can be used.

The following example is given to illustrate the present invention in greater detail.

COMPARATIVE EXAMPLE

(a) Preparation of Photosensitive Emulsion

After simultaneously mixing an aqueous solution of silver nitrate and an aqueous solution of sodium chloride in an aqueous solution of gelatin held at 40° C. in the presence of $5.0\times10^{-5}$ mol of $(NH_4)_3RhCl_6$ per 1 mol of silver, gelatin was added after removal of the soluble salts, and 6-methyl-4-hydroxy-1,3,3*a*,7-tetraazaindene was added as a stabilizer without chemical ripening. This emulsion was a monodisperse emulsion having particles of a cubic crystal form and with an average size of 0.08μ.

(b) Coating of the Photosensitive Layer

Hydrazine Compounds (a) and (b) below were then added to the above emulsion.

(a)

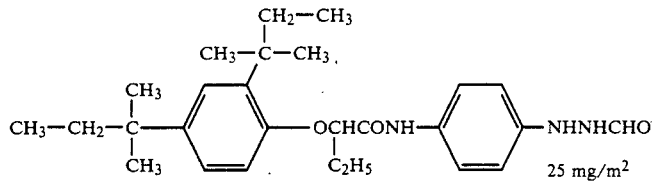

(b)

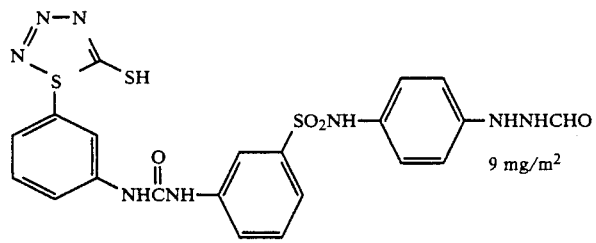

Any of the fixers generally in use may be used, for example, thiosulfate, thiocyanate, and organic sulfur compounds, known for their effect as a fixer. Water-soluble aluminum salts may be added to the fixer as a hardener.

The processing temperature for the method of the invention normally is between 18° C.–50° C.

Furthermore, after adding Nucleating Accelerators (c), (d), and Dyes (e), (f), a solid polyethyl acrylate latex was added to the gelatin as a solid fraction at 30% by weight, and 1,3-divinylsulfonyl-2-propanol was added to the gelatin at 1.6% by weight. This mixture was then coated onto a 100μ polyester support. The quantity of gelatin used was 1.8 g/m², and that of the silver was 3.8 g/m².

(Nucleating Accelerators)

-continued (c) 20 mg/m²

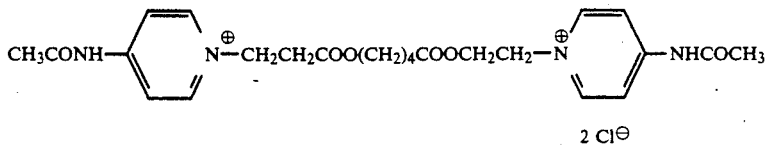

(d) 55 mg/m²

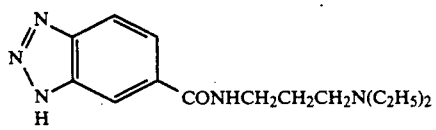

(Dyes)

(e) 100 mg/m²

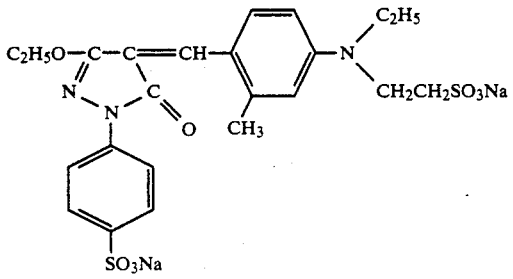

(f) 50 mg/m²

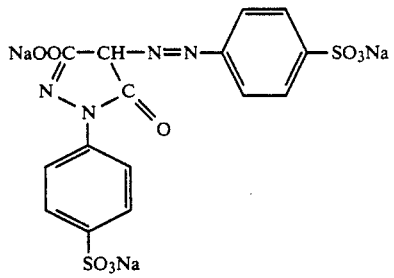

As a protective layer, 1.5 g/m² of gelatin and a layer of 0.3 g/m² of polymethylmethacrylate of a particle size of 1.5μ was coated thereon.

This sample was exposed through an optical wedge in a bright room printer p-607 made by Dai Nippon Screens Ltd. The exposed film was observed under fluorescent light, but the exposed pattern could not be made out at all. The film was then processed in developing solution at 38° C. for 20 seconds, and after fixing, washing drying, a high contrast Dmax good quality image was obtained. The developing solution used have the following composition.

| | |
|---|---|
| Hydroquinone | 45.0 g |
| N-Methyl-p-aminophenol ½ Sulfate | 0.8 g |
| Sodium Hydroxide | 18.0 g |
| Potassium Hydroxide | 55.0 g |
| 5-Sulfosalicylic Acid | 45.0 g |
| Boric Acid | 25.0 g |
| Potassium Sulfite | 110.0 g |
| Ethylenediaminetetraacetic Acid, Disodium Salt | 1.0 g |
| Potassium Bromide | 6.0 g |
| 5-Methylbenzotriazole | 0.6 g |
| 2-Mercaptobenzimidazole-5-sulphonic Acid | 0.3 g |
| N-Butyl Diethanolamine | 15.0 g |
| Water to make | 1 Liter |

EXAMPLE 1

In place of the 100μ polyester support used in the Comparative Example, a 100μ polyester support which had already been coated with the following backing layer was used.

| Backing layer | |
|---|---|
| Novolack Resin | 4.2 mg/m² |
| Victoria Pure Blue (C.I.42595) | 0.06 |
| Free Radical Former (Compound (I-1)) | 0.02 |

This was exposed in the same way as in the Comparative Example and, when observed under fluorescent light, the exposed pattern was clearly seen.

When processed in the same way as in the Comparative Example, a good quality image identical to that in the Comparative Example and free from stains was obtained.

EXAMPLE 2

Samples with the following compositions were prepared as color alterants and free radical formers as in Example 1. These were exposed in the same way, and an exposure pattern was observed in each case. A stain-free good quality image was obtained after developing.

| Sample No. | Color Alterant | Free Radical Former |
|---|---|---|
| 2-1 | Victoria Pure Blue | Compound (I-4) |
| 2-2 | Compound F-1 | Compound (I-1) |
| 2-3 | Compound F-4 | Compound (I-1) |
| 2-4 | Compound F-1 | Compound (I-2) |

EXAMPLE 3

In place of the backing layer in Example 1, the following backing layer was used:

| | |
|---|---|
| Gelatin | 3.3 g/m$^2$ |
| Color Alterant (Compound F-6) | 0.05 |
| Free Radical Former (Compound (I-3)) | 0.02 |

An exposure pattern was observed in the same way as in Example 1. A stain-free good quality image was obtained after developing.

EXAMPLE 4

In place of the Free Radical Former Compound (I-3) used in Example 3, Compounds (I-10), (I-13) and (I-22) were used, with identical results.

EXAMPLE 5

In the place of the backing layer used in Example 1, the following backing layer was used:

| | |
|---|---|
| Gelatin | 3.8 g/m$^2$ |
| Poly (tert-butylacrylamide) | 0.3 |
| Color Alterant (Victoria pure blue CI.42595) | 0.06 |
| Free Radical Former (Compound (I-4)) | 0.02 |

This backing layer was coated after forming a fine dispersion by dissolving the poly(t-butylacryl-amide), Victoria pure blue and Compound (I-4) in ethyl acetate, and adding this to an aqueous solution of gelatin at 50° C. while stirring at high speed. An exposure pattern was observed in the same way as in Example 1. A stain-free good quality image was obtained after developing.

While the present invention has been described in detail and with reference to specific embodiments thereof, it is apparent to one skilled in the art that various changes and modifications can be made therein without departing from the spirit and the scope of the present invention.

What is claimed is:

1. A silver halide photosensitive material comprising a support having thereon a layer containing (a) an organic compound which releases a free radical on contact with light rays and (b) a compound which undergoes a change in the absorption spectrum by changing from a colored state to a colorless state due to the action of the released free radical, wherein the organic compound which releases a free radical on contact with light is a compound shown by the general formula (I):

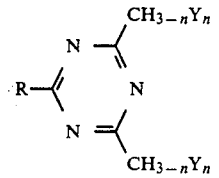

(I)

wherein Y represent Cl or Br, n is an integer from 1 to 3, and R represents an aromatic group which may or may not be substituted, and wherein the compound which changes from a colored state to a colorless state is an oxonol dye or a benzylidene dye.

2. A silver halide photosensitive material according to claim 1, wherein the substituent for the aromatic group for R is one or more of an alkyl group, an alkoxy group, an aryl group, a halogen atom, a hydroxyl group, a carboxyl group, a sulfo group, an alkoxy carbonyl group, a carbamoyl group, an acylamino group, an amino group, a sulfamoyl group, and a sulfonamide group.

3. A silver halide photosensitive material according to claim 2, wherein the aromatic group for R is a phenyl group or a naphthyl group.

4. A silver halide photosensitive material according to claim 1, wherein the compound which releases a free radical is present in an amount of about 0.01 to about 100 parts per part by weight of the compound that undergoes a change in the absorption spectrum.

5. A silver halide photosensitive material according to claim 1, wherein the layer containing the compound that undergoes a change in the absorption spectrum and the compound which releases a free radical on contact with light contains a water soluble binder.

6. A silver halide photographic material according to claim 1, wherein the compound that undergoes a change in the absorption spectrum is present in a range of 1.0 to 1000 mg/m$^2$ in a silver halide photosensitive material.

* * * * *